US006653980B2

(12) United States Patent
Ceccom et al.

(10) Patent No.: US 6,653,980 B2
(45) Date of Patent: Nov. 25, 2003

(54) ANTENNA FOR TRANSMISSION / RECEPTION OF RADIO FREQUENCY WAVES AND AN AIRCRAFT USING SUCH AN ANTENNA

(75) Inventors: Rene Ceccom, Saiguede (FR); Claude Pichavant, Toulouse (FR)

(73) Assignee: Airbus France, Toulouse Cedex (FR)

( * ) Notice: Subject to any disclaimer, the term of this patent is extended or adjusted under 35 U.S.C. 154(b) by 0 days.

(21) Appl. No.: 10/155,778

(22) Filed: May 24, 2002

(65) Prior Publication Data

US 2002/0186170 A1 Dec. 12, 2002

(30) Foreign Application Priority Data

May 25, 2001 (FR) ..... 01 06903

(51) Int. Cl.[7] ..... H01Q 1/28
(52) U.S. Cl. ..... 343/705; 343/708; 343/767
(58) Field of Search ..... 343/705, 708, 343/767, 770, 872, 878

(56) References Cited

U.S. PATENT DOCUMENTS 2,505,751 A * 5/1950 Bolljanh ..... 343/708
3,534,370 A 10/1970 Stang ..... 343/208
3,943,520 A * 3/1976 Apstein et al. ..... 343/708
5,187,489 A * 2/1993 Whelan et al. ..... 343/767
5,461,392 A * 10/1995 Mott et al. ..... 343/725
5,748,152 A * 5/1998 Glabe et al. ..... 343/767
5,825,332 A * 10/1998 Camacho et al. ..... 343/708
6,047,925 A * 4/2000 Rivera et al. ..... 244/129.4
6,094,171 A * 7/2000 Riddle et al. ..... 343/708

FOREIGN PATENT DOCUMENTS

GB 643557 9/1950
GB 803723 10/1958 ..... 40/7

* cited by examiner

*Primary Examiner*—Don Wong
*Assistant Examiner*—Shih-Chao Chen
(74) *Attorney, Agent, or Firm*—Thelen Reid & Priest, LLP; Robert E. Krebs

(57) ABSTRACT

This invention relates to an aircraft using such an antenna comprises: a structural element (8) that is conducting in the operating frequency band of the antenna, with size equal to at least one quarter of the wave length along the polarization direction of the electromagnetic wave for the minimum frequency of this frequency band, and comprising a cutout forming a cavity (9); a removable exciting element (10) placed in this cavity that acts as an exciter of this cavity (9); and a metallization that is electrically conducting at the operating frequencies of the antenna providing metallization between the exciting element (10) and the structural element (8).

12 Claims, 3 Drawing Sheets

ANTENNA FOR TRANSMISSION / RECEPTION OF RADIO FREQUENCY WAVES AND AN AIRCRAFT USING SUCH AN ANTENNA

TECHNICAL FIELD

This invention relates to an antenna for transmission/reception of radio frequency waves composed of a removable exciting element integrated into a fixed or mobile structure, for example an aircraft, making all or part of the structural element in which it is integrated radiate, and an aircraft using such an antenna.

STATE OF THE ART

In the remainder of the description, the antenna according to the invention integrated into the aircraft structure is considered as a non-limitative example. But it could also be integrated into any other type of vehicle.

An antenna has to be used in order to make a radio frequency link for transmission or reception. A dipole type antenna which is used particularly for radio frequency reception onboard an aircraft requires a ground plane with a large area and a sufficiently long antenna for the radio frequencies considered.

In an aircraft, the antennas are protected; the radiating part is sheltered by a radome composed partly of a material that is transparent to electromagnetic waves. This protection must be profiled so as to minimize disturbance to aerodynamic performances. Furthermore, electromagnetic decoupling values between the different antennas that must comply with the requirements of standards (particularly ARINC) result in physical separation constraints between antennas working in the same frequency bands.

Thus, in a small aircraft, the addition of an antenna can create problems.

In order to avoid disturbing the aerodynamic characteristics of an aircraft, it will be possible to use an antenna integrated into the structure of this aircraft.

An American patent U.S. Pat. No. 6,047,925 thus describes a narrow band UHF antenna integrated into the landing gear door of an aircraft. Due to its installation principle, the antenna has to be retuned after each time that it is disassembled. This action, if it has to be taken during a stopover of an aircraft operated by an airline company, is very inconvenient (extra cost, immobilization of the aircraft, very specialized tooling, etc.).

A French patent application FR 1 091 358 describes another type of antenna integrated into the structure of an aircraft. This antenna is a large band slit antenna, with relatively large dimensions. Therefore, it must form part of a structural element of the aircraft with appropriate dimensions (tail fin, etc.) without it being possible to separate the antenna from the structural element. Removing or replacing such an antenna requires disassembly and possibly replacement of the structural element considered. In addition to difficulties in installing such an antenna, maintenance costs are high and aircraft immobilization times are long.

The purpose of this invention is an antenna composed of an excitation element that can easily be integrated into a structural element forming the radiating part of the antenna without disturbing the overall aerodynamic performances, the said excitation element being removed from the structural element without needing to replace the structural element. In particular, the structural element may be part of a construction (for example a building or a ship) or a vehicle (for example an aircraft).

DESCRIPTION OF THE INVENTION

This invention divulges an antenna for the transmission/reception of radio frequency waves comprising:

- a structural element that is conducting in the operating frequency band of the antenna, with size equal to at least one quarter of the wave length along the polarization direction of the electromagnetic wave for the minimum frequency of this frequency band, and comprising a cutout forming a cavity,
- a removable exciting element placed in this cavity that acts as an exciter of this cavity,
- a link that is electrically conducting at the operating frequencies of the antenna, providing metallization between the said exciting element and the said structural element.

In one advantageous embodiment, this exciting element comprises:

- an element made of a material transparent to radio frequency waves filled with a material that is also transparent to radio frequency waves,
- a conducting strip forming a stub, used for tuning and matching the antenna on the operating frequency band,
- a cover made of a material transparent to radio frequency waves, containing the exciting element and maintaining continuity of the profile of the structural element,
- a stub power supply line.

In one advantageous example embodiment, the exciting element and the cover are made of glass fiber. The material that fills in the exciting element is a resin or a cast thermoplastic material. The stub is made of copper covered on the surface with a silver plated layer. The cover is fixed to the exciting element using non-magnetic screws. The shape of the exciting element is such that it can be fixed in a notch formed in a structural element of a building or a vehicle, for example an aircraft.

This invention also relates to an aircraft in which at least one of the wing end elements comprises a notch-shaped cavity in which an exciting element like that described above is placed.

The antenna according to the invention has many advantages:

- it does not modify the aerodynamic properties of the aircraft since it is integrated into a structural element of the aircraft,
- it is easy to put into place and to maintain (disassembly, standard replacement, etc.); no adjustment or tuning operation is necessary after the antenna has been installed,
- therefore maintenance costs are low,
- it may be offered as optional equipment in an aircraft; it does not form part of the structure of the aircraft, but it can be fixed to the structure. A simple protective cover can thus protect the notch formed in the structure of the aircraft at the position at which the exciting element is fitted,
- it may be integrated into a structural element sufficiently far away from other antennas using the same frequency band; this means that electromagnetic decoupling values imposed between antennas can be respected.

DETAILED DESCRIPTION OF EMBODIMENTS

Figure 1:
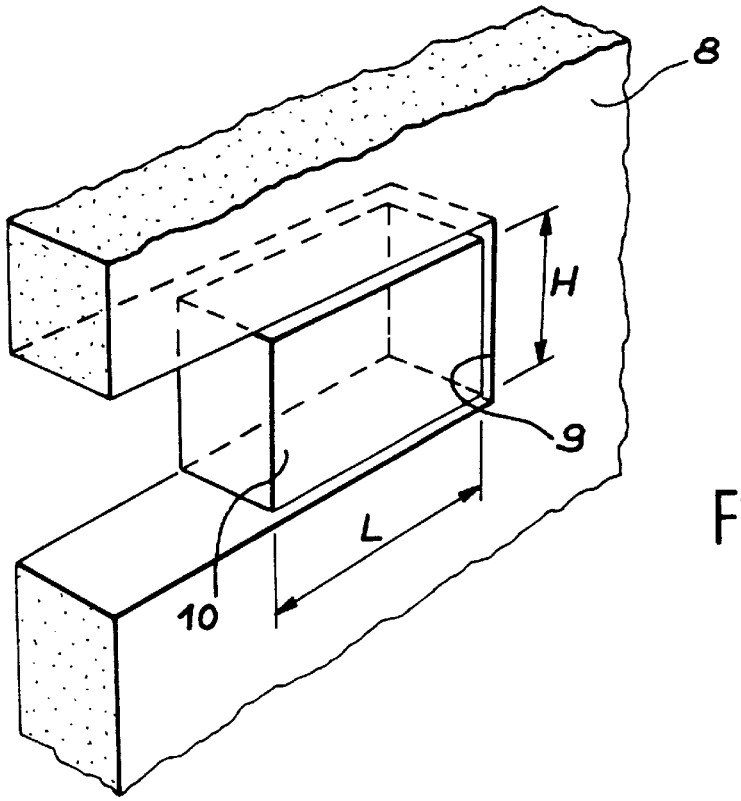
FIG. 1 illustrates the antenna according to the invention.

As illustrated in FIG. 1, the antenna for transmission/reception of radio frequency waves according to the invention comprises:

- a structural element 8 that is conducting in the operating frequency band of the antenna, with a dimension equal to at least one quarter of the wave length along the polarization direction of the electromagnetic wave for the minimum frequency of the frequency band, and comprising a cutout forming a cavity 9,
- a removable exciting element 10 placed in this cavity that acts as an exciter of this cavity,
- a link that is electrically conducting at the operating frequencies of the antenna, providing metallization between the said exciting element 10 and the said structural element 8.

Figure 2:
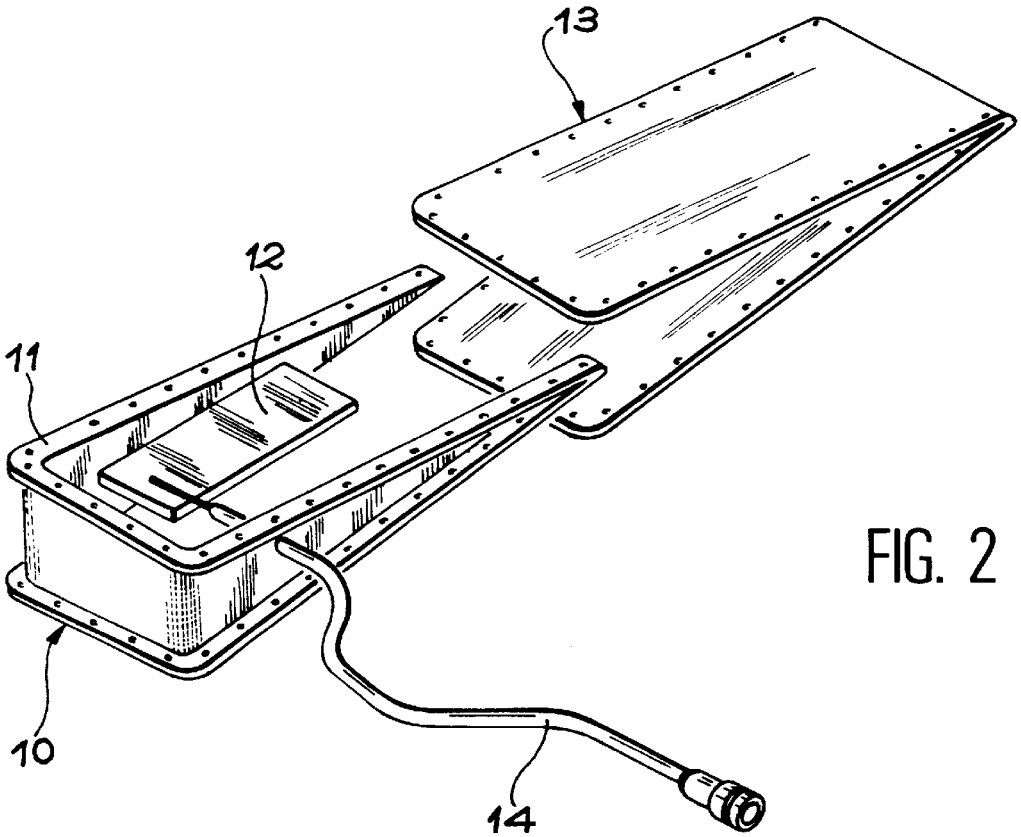
FIG. 2 illustrates an exploded view of an example embodiment of the antenna according to the invention.

FIG. 2 shows an advantageous embodiment of the removable exciting element 10 of the antenna for transmission/reception of radio frequency waves according to the invention that comprises:

- an element 11 made of a dielectric material transparent to radio frequency waves, for example made of glass fiber, filled with a material that is also transparent to radio frequency waves, for example made of resin or a cast thermoplastic material,
- a conducting strip forming a stub 12, for example made of copper, covered on the surface with a silver plated layer to improve conduction (almost all conduction in the frequency range considered takes place on the surface (skin effect)), the conducting strip placed in this element 11 is used to tune and match the antenna on the frequency band used,
- a cover 13 made of a material transparent to radio frequencies, for example made of glass fiber, for example fixed using non-magnetic screws around the circumference of the cavity, these screws also providing the metallization between the exciting element and the structural element, for example by enabling electrical contact between this conducting structural element 8 and copper foil connected to the ground braid of the coaxial cable 14 supplying power to the stub 12,
- a stub power supply line 14, for example a coaxial cable fitted with a standard connection in order to connect the antenna to a coaxial cable connected to a transmitter/receiver.

This exciting element 10 may be fixed, as equipment, into a notch formed in the structure of a building or a vehicle, for example an aircraft, the dimensions of this notch determining the pass band of the antenna. The assembly consisting of the exciting element integrated into the structural element thus forms a narrow band slit antenna. The exciting element is located in the "slit" part of this slit antenna.

Radiation from the antenna uses the structural element 8 that contains the exciting element 10. This structural element must be composed of a material that is a sufficiently good conductor at the frequencies used, for example aluminum, and is sufficiently large (at least one quarter of the wave length along the polarization direction of the electromagnetic wave).

In practice, the standing wave ratio (SWR) is less than 2 on the frequency band on which the antenna is used.

The dimensions of the antenna depend on the required frequency band; when the frequency is reduced (for example in HF), the dimensions increase and the frequency limits depend on possibilities of integration into the structure. When the frequency is increased (for example in UHF), the dimensions reduce. However, it is impossible to increase the frequency too much due to technological constraints in making the cavity.

The minimum frequencies that can be transmitted are imposed by the structural element 8 in which the said exciting element 10 is to be integrated. This structural element must have at least one part in which the length along the required polarization direction is greater than or equal to the quarter of the wave length corresponding to this minimum frequency.

The minimum dimension along the polarization direction is equal to one quarter of the wave length, which is c/4.f, where c is the speed of light (3.10^8 m/s) and f is the frequency in Hertz. If the required polarization is vertical, this minimum dimension is the height H shown in FIG. 1.

If a minimum dimension of a few meters is considered (to be technically feasible), the result is an antenna capable of covering the HF band (2–30 MHz).

The maximum frequencies that can be transmitted by such an antenna are estimated at about 5 GHz for industrial applications. This corresponds to a 17 mm long and 3 mm high slit. This frequency limitation is due to difficulties with the industrial production of a cavity smaller than these dimensions. Therefore, this type of antenna would cover the UHF band.

The invention can then be used for the HF, VHF and UHF bands.

Figure 3:
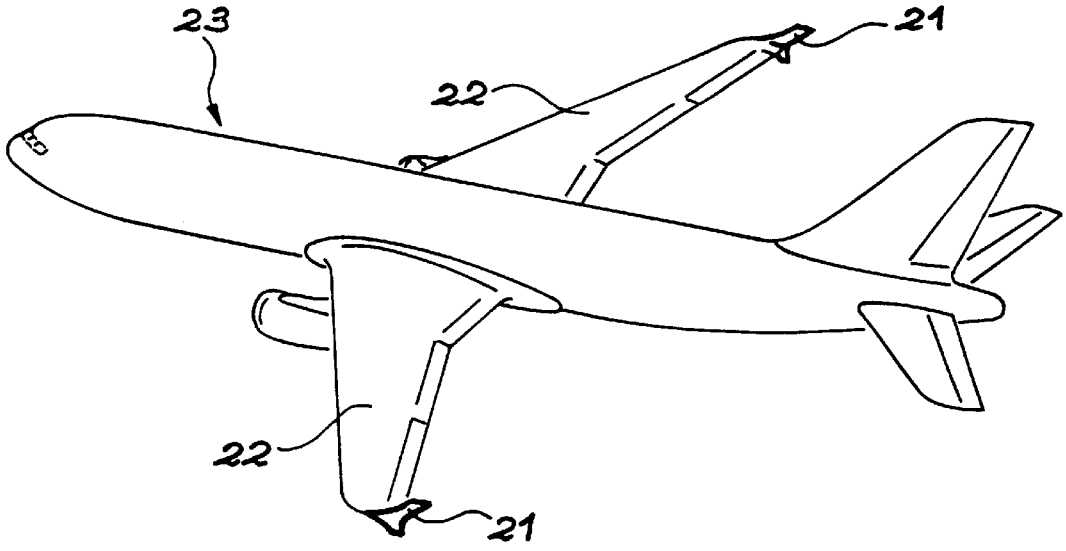
FIGS. 3 and 4 illustrate the position of the structure of the aircraft at which the antenna according to the invention can advantageously be integrated.
Figure 4:
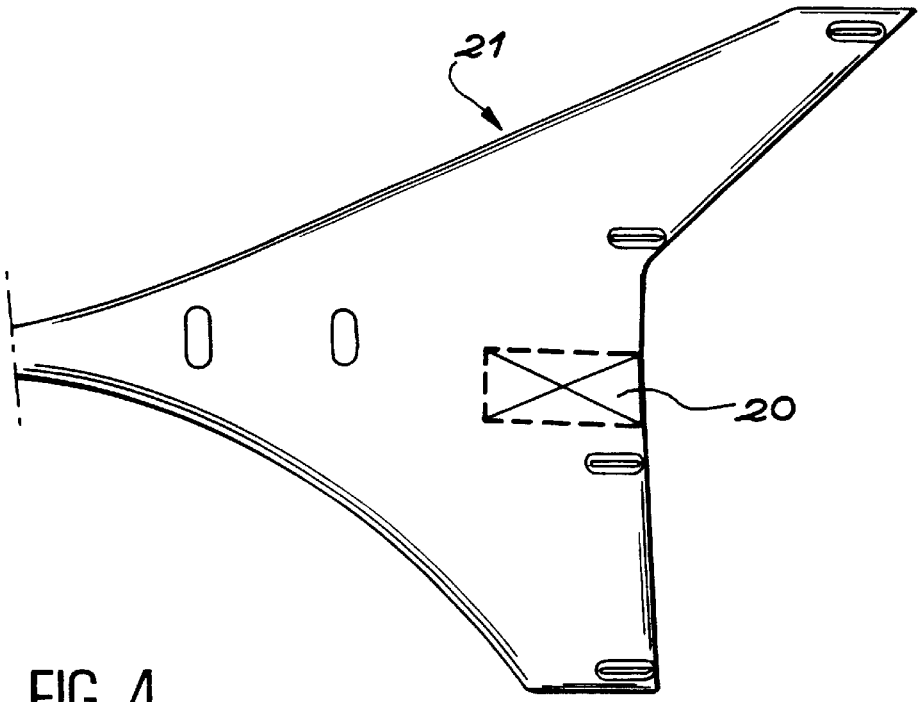

In one example embodiment shown in FIGS. 3 and 4, the exciting element of the invention is integrated into a cavity 20 in one of the end elements 21 of the wings 22 of an aircraft 23 ("wing tip fence" on "winglet", or the end tips of a wing).

As shown in FIG. 4, this type of cavity 20 may be located in the trailing edge of such an element.

This type of position minimizes modifications that have to be made to stiffeners provided to enable the said wing end elements to resist aerodynamic forces during flight of the aircraft. But other positions are also possible.

The stub coaxial power supply cable is connected to the inside of these elements through a connector, to a coaxial cable connected to the transmitter/receiver. This coaxial cable runs along the wing of the aircraft and inside it. Radiation from the antenna takes place through the corresponding end element.

This antenna layout makes it possible to respect radio electric decoupling with other radio communication and navigation antennas using the same frequency band since the said elements are located in the end part of the wing that is sufficiently far away from the said other antennas. Furthermore, this type of layout is a means of achieving a radiation diagram that is satisfactory upwards and downwards since, at the end of the wings, the aircraft structure does not hinder propagation of waves upwards or downwards.

In one specific embodiment, an exciting element as shown in FIG. 2 at full scale is considered. The dimensions of this element are as follows:

length L=170 mm height H=83 mm.

Figure 5:
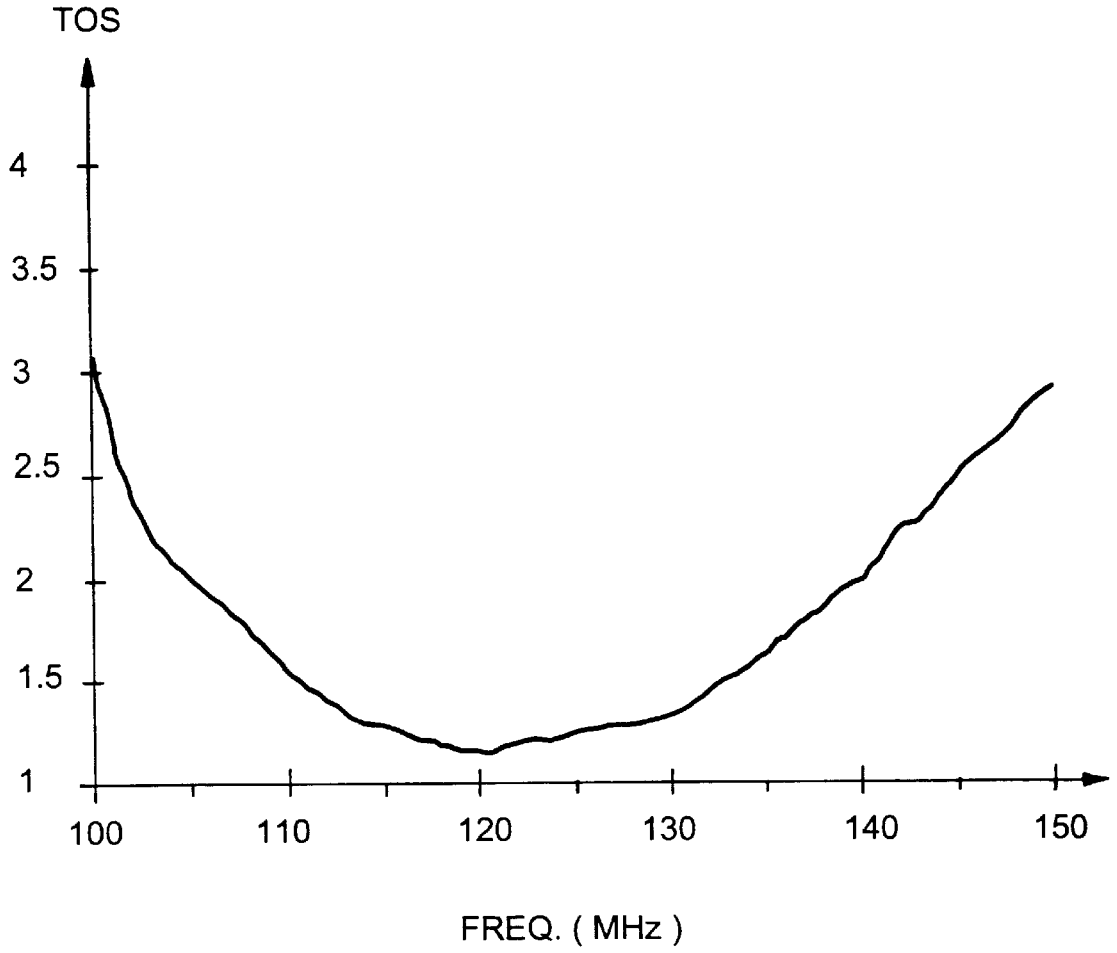
FIG. 5 illustrates an SWR response curve as a function of the frequency of the antenna according to the invention.

As shown in FIG. 5, the antenna made by integrating the exciting element 10 into the cavity 20 formed in one of the end elements 21 of the wings 22 of an aircraft 23 has an SWR (standing wave ratio) less than or equal to 2 on the civil VHF band (108–137 MHz) in which it is used with a vertical direction of polarization of the electromagnetic wave.

In the above description, the antenna according to the invention was described in the special case in which it is integrated into an aircraft. But it can equally well be integrated into any type of vehicle (boat, automobile, etc.) with a structural element with sufficiently large dimensions compared with the wave lengths considered, both to perform the radiating element function and so that a sufficiently large notch can be formed in it to insert the exciting element, and the material from which it is made conducts sufficiently well at the antenna operating frequencies.

This type of antenna also has the advantage that the vehicle must have good aerodynamic performances.

It can also be used for fixed installations (buildings, etc.) subject to severe environmental constraints (violent winds, etc.).

What is claimed is:

1. Antenna for the transmission/reception of radio frequency waves comprising:

a structural element (8) that is conducting in the operating frequency band of the antenna, with size equal to at least one quarter of the wave length along the polarization direction of the electromagnetic wave for the minimum frequency of this frequency band, and comprising a cutout forming a cavity (9), a removable exciting element (10) placed in this cavity that acts as an exciter of this cavity (9), a metallization that is electrically conducting at the operating frequency of the antenna, providing metallization between the said exciting element (10) and the said structural element (8), and in that this exciting element (10) comprises:

an element (11) made of a material transparent to radio frequency waves filled with a material that is also transparent to radio frequency waves, a conducting strip (12) forming a stub, used for tuning and matching the antenna on the operating frequency band, a cover (13) made of a material transparent to radio frequency waves, containing the exciting element (10) and maintaining continuity of the profile of the structural element (8), a stub power supply line (14).

2. Antenna according to claim 1, in which the exciting element (10) and the cover (13) are made of glass fiber.

3. Antenna according to claim 1, in which the material that fills the exciting element (10) is a resin or a cast thermoplastic material.

4. Antenna according to claim 1, in which the stub is made of copper covered with a silver plated layer on the surface.

5. Antenna according to claim 1, in which the cover (13) is fixed on the exciting element (10) using non-magnetic screws.

6. Antenna according to claim 1, in which the exciting element (10) is shaped such that it can be fixed in a notch formed in a structural element of a building or a vehicle.

7. Antenna according to claim 6, in which the said vehicle is an aircraft.

8. Aircraft, characterized in that at least one of its structural elements is fitted with a cavity in which an exciting element (10) is placed according to claim 1.

9. Aircraft characterized in that at least one of its wing and elements (21) is provided with a cavity in which an exciting element (10) according to claim 1 is placed.

10. Antenna according to claim 5, in which the exciting element (10) is shaped such that it can be fixed in a notch formed in a structural element of a building or a vehicle.

11. Aircraft, characterized in that at least one of its structural elements is fitted with a cavity in which an exciting element (10) is placed according to claim 6.

12. Aircraft characterized in that at least one of its wing and elements (21) is provided with a cavity in which an exciting element (10) according to claim 6 is placed.

* * * * *